US005391963A

United States Patent [19]

Allen et al.

[11] Patent Number: 5,391,963

[45] Date of Patent: Feb. 21, 1995

[54] TRAVELING WAVE TUBE WITH THERMALLY-INSENSITIVE LOSS BUTTON STRUCTURE

[75] Inventors: Curtis G. Allen, Hayward; David H. Perrone, Redwood City; David M. Rossi, San Francisco, all of Calif.

[73] Assignee: Litton Systems, Inc., Beverly Hills, Calif.

[21] Appl. No.: 968,417

[22] Filed: Oct. 29, 1992

[51] Int. Cl.[6] ..... H01J 23/30

[52] U.S. Cl. ..... 315/3.5; 315/39.3; 333/81 R

[58] Field of Search ..... 315/3.5, 3.6, 39.3; 333/81 R

[56] References Cited

U.S. PATENT DOCUMENTS

| | | | |
|---|---|---|---|
| 3,221,204 | 11/1965 | Hant et al. | 315/3.5 |
| 4,001,630 | 1/1977 | Gross | 315/3.5 |
| 4,143,341 | 3/1979 | Gross | 315/3.5 X |
| 4,307,322 | 12/1981 | Chaffee et al. | 315/3.5 |

FOREIGN PATENT DOCUMENTS

| | | | |
|---|---|---|---|
| 2325619 | 11/1974 | Germany | 315/3.5 |
| 3025834 | 2/1991 | Japan | 315/39.3 |

*Primary Examiner*—Benny T. Lee
*Attorney, Agent, or Firm*—Elliott N. Kramsky

[57] ABSTRACT

A loss button for a traveling wave tube. The front and rear planar surfaces of the ceramic pill-shaped button body are of coated metallic composition. The periphery is uncoated to permit r.f. energy to enter the button through thee cavity of the planar, metallic spacer into which the button is inserted. By coating the body surfaces, the button itself acts as a resonant cavity for attenuation of a predetermined bandwidth so that the dimensional changes that occur during heating to the surrounding and adjacent metallic elements, including the cavity in the spacer for receiving the button and the adjacent braze washers, will not affect the attenuation band of the tube.

9 Claims, 5 Drawing Sheets

FIG. 4
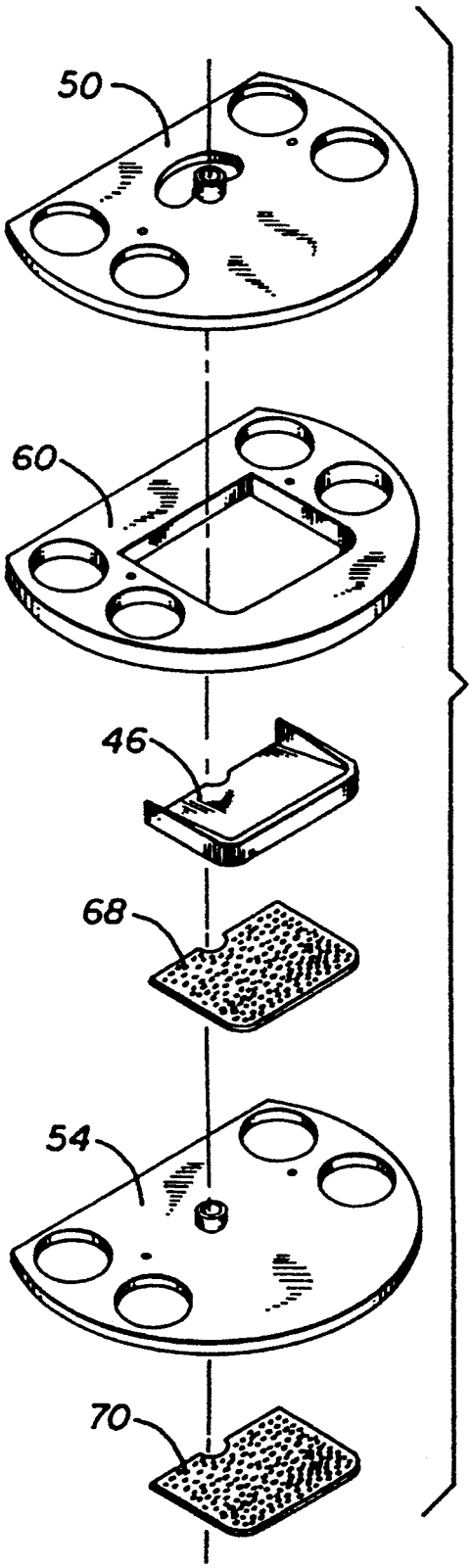
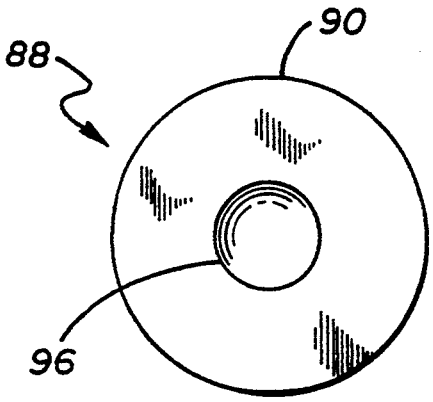
FIG. 6(A)
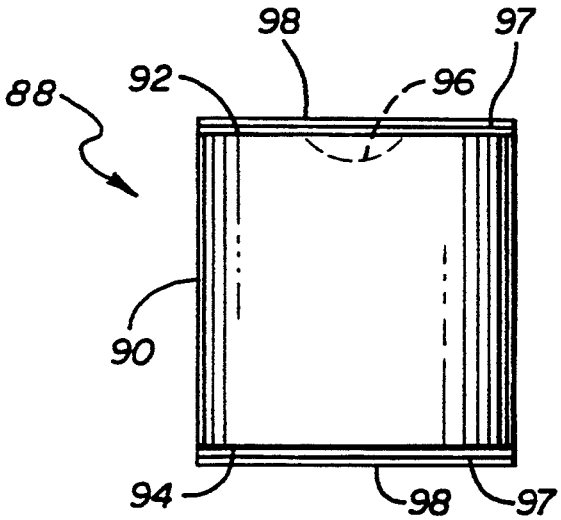
FIG. 6(B)

TRAVELING WAVE TUBE WITH THERMALLY-INSENSITIVE LOSS BUTTON STRUCTURE

BACKGROUND

1. Field of the Invention

The present invention relates to methods and apparatus for tuning a traveling wave tube of the coupled cavity type. More particularly, this invention pertains to a traveling wave tube that includes loss buttons of improved design.

2. Description of the Prior Art

The traveling wave tube is a type of vacuum device which serves as an amplifier of microwave frequency energy. It relies upon the electromagnetic interaction that can occur between an electron beam and a microwave frequency signal. The microwave signal propagates along a slow wave structure that causes it to traverse an extended distance between two axially spaced points. This reduces the effective lateral propagation velocity from that of light to that of the electron beam velocity and transfers energy from the beam to the signal. By lowering the propagation velocity, an energy transferring electronic interaction coupling caused to take place between the beam and the microwave signal that amplifies the microwave frequency energy.

The conventional coupled cavity type traveling wave tube comprises an arrangement of interconnected cells that are serially disposed and adjacent one another along a common axis. A plurality of axially aligned passages through the cavities permits passage of the beam and each interaction cavity is coupled to an adjacent cavity by means of a coupling aperture in an endwall. Conventionally, the coupling apertures between adjacent cavities are alternately disposed on opposite sides of the electron beam axis. An electron gun containing a cathode is located within the tube for furnishing a source of electrons that are formed into a beam and directed along a straight path through the cavity passages. The electromagnetic interaction occurs along the electron beam and the microwave signal appearing at the cavity proximate the beam.

The beam is confined or focussed to the axial path by magnetic means to minimize spreading. So-called pole pieces define the cavities and walls of the slow wave structure while magnets positioned outside the vacuum region of the tube provide the magnetic flux. Protruding ferrules project from the front and back sides of the pole piece walls, serving to surround the electron beam passage and providing a concentrated, axially-extending magnetic field between the ferrule of one pole piece and that of an adjacent pole piece. The beam passage formed in the pole piece between the ends of the ferrules functions as a drift tube region.

A common tube structure also includes one or more termination pieces for absorbing spurious microwave signal energy. Such termination pieces, formed of an appropriate ceramic material such as aluminum oxide or beryllium oxide impregnated with silicon carbide eliminate undesired signal reflection in the tube that can result from passive devices coupled to the input and output ends thereof. Such element(s) are located within a termination cavity that can include metallic elements such as sever and termination pole pieces. Depending upon the type of tube employed, the pole pieces may be of either iron (magnetic) or copper (non-magnetic) composition in accordance with the chosen mechanism for focussing the electron beam.

While the termination piece(s) serves as a circuit element for obtaining broadband power absorption, traveling wave tubes also commonly employ so-called resonant loss buttons that are tuned to attenuate specific frequencies. Such buttons are designed to provide a predetermined amount of insertion loss over a specified frequency range. The absorption of such power will reduce the gain of the tube at such frequencies, preventing oscillation and eliminating undesired outputs. The loss buttons are pill-shaped elements formed of an appropriate ceramic material such as magnesium oxide and silicon carbide (MgO Sic) and are designed to fit into circular aperture-like cavities formed in the cavity spacers.

The frequency of attenuation achieved by a loss button is a function of a number of factors including the material composition of the button and the air gap formed between the planar surfaces of the button and the pole pieces. The axial thickness of the button is reduced by grinding after delivery from a vendor to increase the resonant frequency and thus the ceramic buttons are commonly fabricated to a slightly thicker or lower frequency dimension. (Note: The grind is conical or semispherical and does not affect the overall dimension of the button.)

The manufacture of the traveling wave tube requires a brazing step to assure the ability of the tube to hold a vacuum. The heating and accompanying flow of alloys that occurs during brazing can adversely affect the functioning of the loss buttons by changing the air gap described above. Further, the absorption of r.f. power during operation can also produce heating that reduces the air gap to lower the resonant frequency of the loss button cavity possibly to frequency bands of very high power content. This can result in the destruction of the button(s) and the consequent degradation of tube performance..

SUMMARY OF THE INVENTION

The preceding and other disadvantages of the prior art are addressed by the present invention that provides a loss button for a traveling wave tube of the type that includes a slow wave structure that comprises a plurality of axially-aligned interaction cavities. Each of such cavities includes a pair of pole pieces for defining the front and back walls thereof and at least one metallic spacer for providing separation between the walls.

The loss button includes a substantially pill-shaped body. The front and rear surfaces of the body include coating layers of preselected metallic composition.

The preceding and other features and advantages of this invention will become further apparent from the detailed description that follows. This detailed description is accompanied by a set of drawing figures. Numerals of the drawing figures, corresponding to those of the written text, point to the features of the invention. Like numerals refer to like features throughout both the

BRIEF DESCRIPTION OF THE DRAWING written text and the drawing figures.

FIGS. 1(A) and 1(B) comprise a side sectional view of a coupled cavity traveling wave tube for employing the loss button structure of the invention;

FIG. 4 is an exploded perspective view of the assembly for engaging the sever pole piece to the termination piece, including a wafer with surface undulations.

FIGS. 6(A) and 6(B) are top plan and elevation views of a loss button in accordance with the invention.

DETAILED DESCRIPTION OF THE PREFERRED EMBODIMENT

Figure 1A:
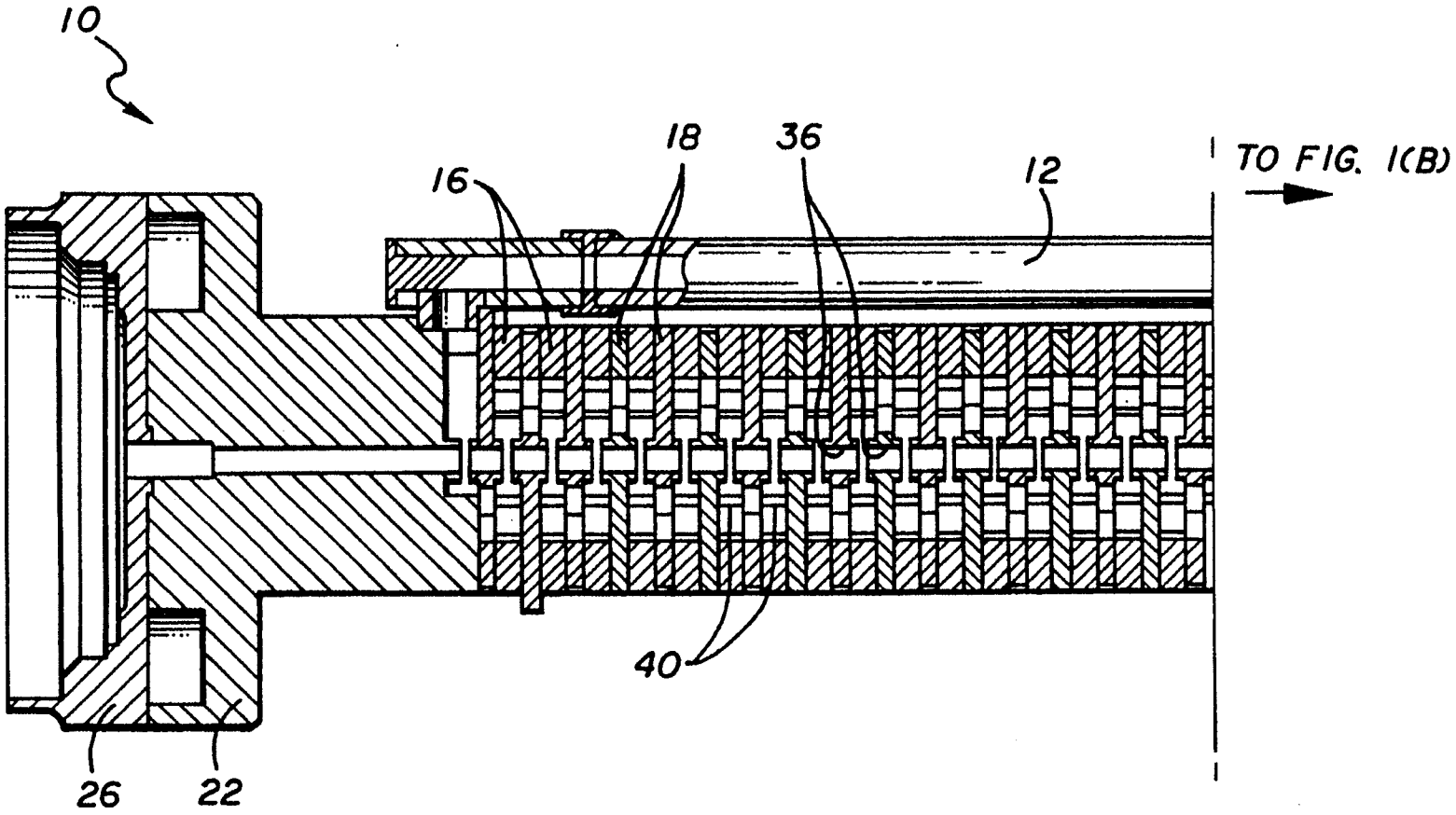
Figure 1B:
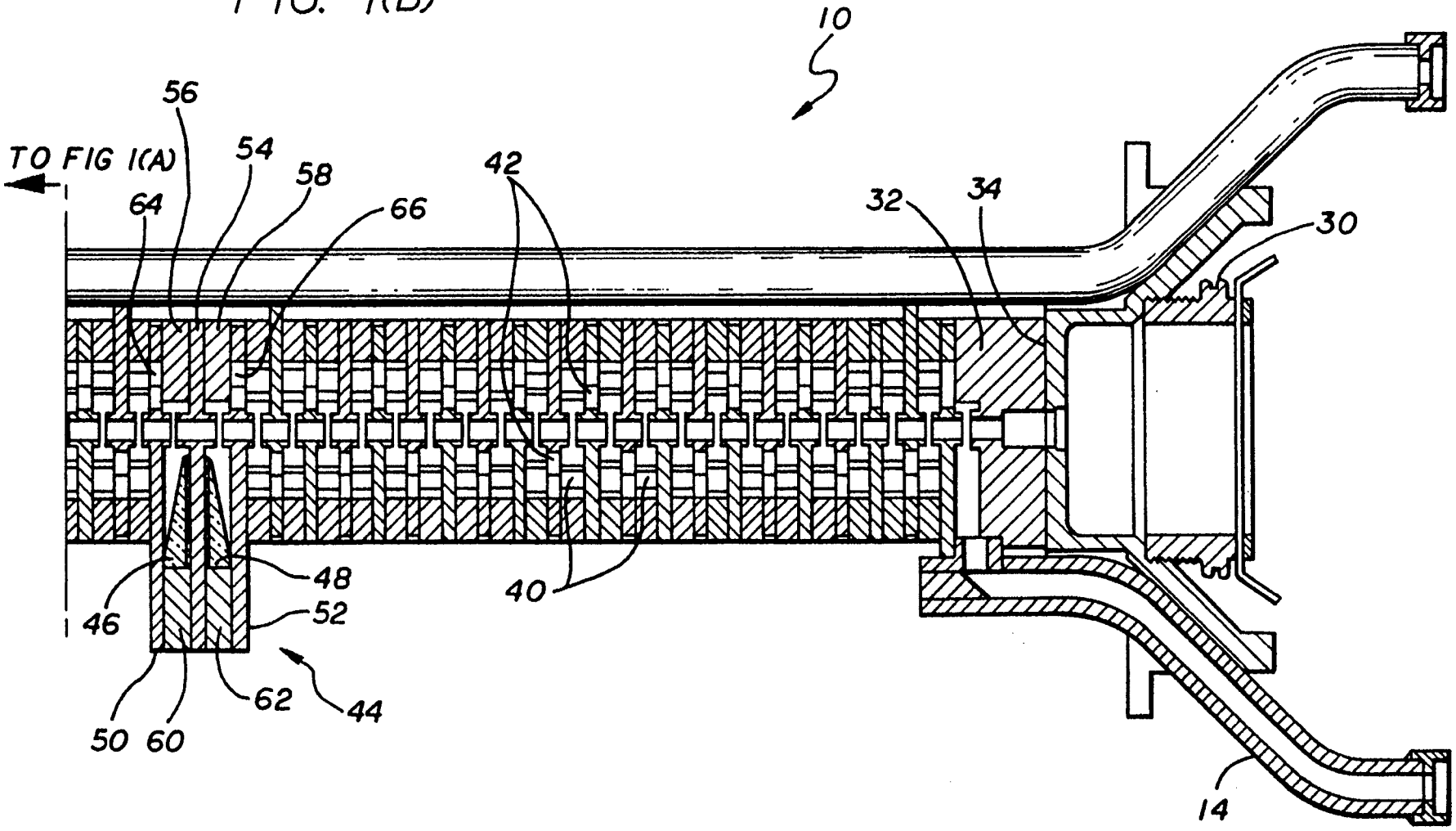

FIGS. 1(A) and 1(B) provide, in combination, a side sectional view of a representative coupled cavity traveling wave tube 10 of the type that can incorporate a loss button structure in accordance with the invention. Input r.f. energy is received through an input waveguide 12 to the body of the tube 10 which functions as a slow wave structure for propagating an electromagnetic wave with a phase velocity substantially less than the velocity of light and substantially equal to the velocity of the electron beam. The high energy amplified r.f. output of the tube 10 is taken through an output waveguide 14.

An electron gun assembly is coupled to an input coupler assembly 22 and includes a gun pole piece 26. The gun assembly 22 generates and propels a beam of electrons along the longitudinal axis of the tube 10 and includes both a cathode and an anode (neither is shown). The cathode functions as a source of electrons and the anode focusses and directs the beam along the predetermined beam axis. A collector insulator assembly 30 and an output coupler 32 are fixed to the opposed or output end of the tube 10. The output coupler 32 includes a collector pole piece 34. The collector assembly gathers electrons from the beam that have passed through the tube's interaction region.

Pole pieces 18 of non-magnetic metallic composition such as copper interact with electromagnets (not shown) to focus the electron beam as it travels through the interior channel formed by the aligned central cylindrical passages 36 of the pole pieces 18. The coupler assembly and the output waveguide 14 include microwave transparent seals for maintaining a vacuum within the tube 10. The electromagnets are an alternative to a beam focusing mechanism of the type that includes permanent magnets in combination with pole pieces of ferromagnetic material. The magnets are driven so that oppositely-poled fields are generated at all times on opposite faces of common pole pieces 18.

The pole pieces 18, in-combination with the electromagnets and the spacers 16 form and define axially spaced interaction cavities 40. Such cavities 40 are coupled through coupling holes 42 located off-axis of the central electron beam passage with the kidney-shaped apertures 42 for passage of the r.f. energy located above and below the beam passage on alternating pole pieces 18.

A termination 44 is provided within the tube 10 for preventing the undesired reflection of r.f. signal energy. The termination 44 includes a first ceramic termination 46 and a second ceramic termination 48 for absorbing forward directed and reflected r.f. energy respectively. Undesired r.f. signal energy will generally be found as a consequence of the impedance mismatches involving the passive elements of microwave devices coupled to the input 12 and to the output 14 of the tube 10. In addition to the ceramic termination pieces 46 and 48, the termination 44 includes termination pole pieces 50 and 52 of appropriate metallic material such as copper, a centrally-located sever pole piece 54, also of metallic composition, upper termination spacers 60 and 62 and lower termination spacers 56 and 58, each of which is also of metallic composition, preferably copper.

In operation, the termination 44 acts to absorb microwave energy. Forwardly-directed energy enters the termination through the kidney-shaped aperture 64 of termination pole piece 50 while reflected energy enters through the aperture 66 of termination pole piece 52. As mentioned earlier, such energy is absorbed at the termination pieces 46 and 48 respectively.

During high power applications of the illustrated traveling wave tube, the temperatures of the ceramic termination pieces 46 and 48 can rise to approximately 400 degrees Celsius in an arrangement in accordance with FIG. 1. This represents a net value as, absent dissipation of heat through the various heat sinks, the absorbed r.f. energy would be sufficient to heat the ceramic pieces 46 and 48 to about 600 degrees Celsius and this is then reduced by about 200 degrees Celsius by heat flows to the copper sever pole piece 54, the termination pole pieces 50 and 52 and the lower spacers 60 and 62. (It can be assumed that, in the worse case, the termination 44 will see about 200 watts of r.f. power. This is based upon the assumption that the tube 10 produces about 2,000 watts average power.)

The r.f. characteristic impedance of the termination 44 changes when excessive heating takes place. Thus, while the impedance of the termination 44 may be identical to that of the tube 10 at relatively low temperatures, the occurrence of excessive heating could disturb impedance matching in the tube 10 and result in the reflection of r.f. energy that would otherwise have been absorbed. This can lead to oscillations within the tube 10 that can render it unusable. Additionally, the boundary conditions of the metallic termination pole pieces 50 and 52 may be affected. Accordingly, it is essential that sufficiently intimate contact be made between the ceramic termination pieces 46 and 48 and the metallic elements capable of acting as heat sinks to maintain the temperatures of the ceramic elements within tolerable limits.

While various metallic elements of the termination 44 are in intimate contact with the ceramic terminations 46 and 48 to facilitate their abilities to function as heat sinks, the brazing or sintering of the bonds joining ceramic termination pieces 46 and 48 directly to those metallic elements has produced element interconnections that can experience failure as a result of the high power (and therefore high temperature) environment of the termination 44. Such failures have been a function of the significantly different coefficients of thermal expansion of the ceramic and metallic elements of the tube 10.

Figure 2:
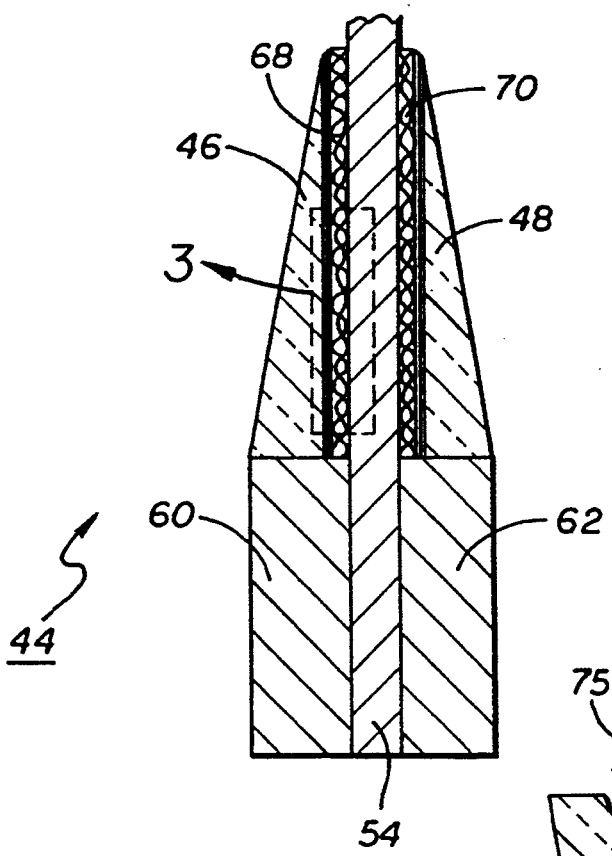
FIG. 2 is an enlarged view of the termination portion of the traveling wave tube of FIG. 1.

FIG. 2 is an enlarged view of the lower half of the termination 44 of the traveling wave tube 10. As can be seen, corrugated wafers 68 and 70 are interposed at the interfaces of the metallic sever pole piece 54 with the ceramic termination pieces 46 and 48 respectively. It should be noted that the corrugated wafers 68 and 70 do not continue the entire length of the pole piece 54 as the spacers 60 and 62 are of like metallic composition, and therefore of like thermal characteristic, to the sever pole piece 54. While the direct brazing or sintering of bonds between the sever pole piece 54 and the copper spacers 60 and 62 is not hampered by the stresses that occur between materials of dissimilar thermal compositions, it will be seen from the discussion below that, in some uses, the waffle plates 68 and 70 may continue the entire length of the sever pole piece 54 and thus be interposed between the elements fabricated of materials of like thermal character.

FIG. 4 is an exploded perspective view of the aforementioned assembly for engaging the sever pole piece 54 to the termination piece 46. As can be seen, the plate or wafer 68 is substantially planar.

The interposition of the waffle plates 68 and 70 between thermally-mismatched elements, "softens" such interfaces to prevent the bond ruptures that result from thermally-induced stressing of so-called "direct" bonds. The wrinkled or quilted plates 68 and 70 each presenting a texture comprising a plurality of discrete convex elements on the opposed sides thereof, are formed of malleable metal or other material. In the event that the wrinkle plate is sintered or brazed to the mismatched elements, considerable thermal or mechanical movement can occur between those elements without any degradation of the r.f. or thermal interface. Additionally, the interposition of the plates 68 and 70 is also very forgiving of dimensional tolerances.

Figure 3:
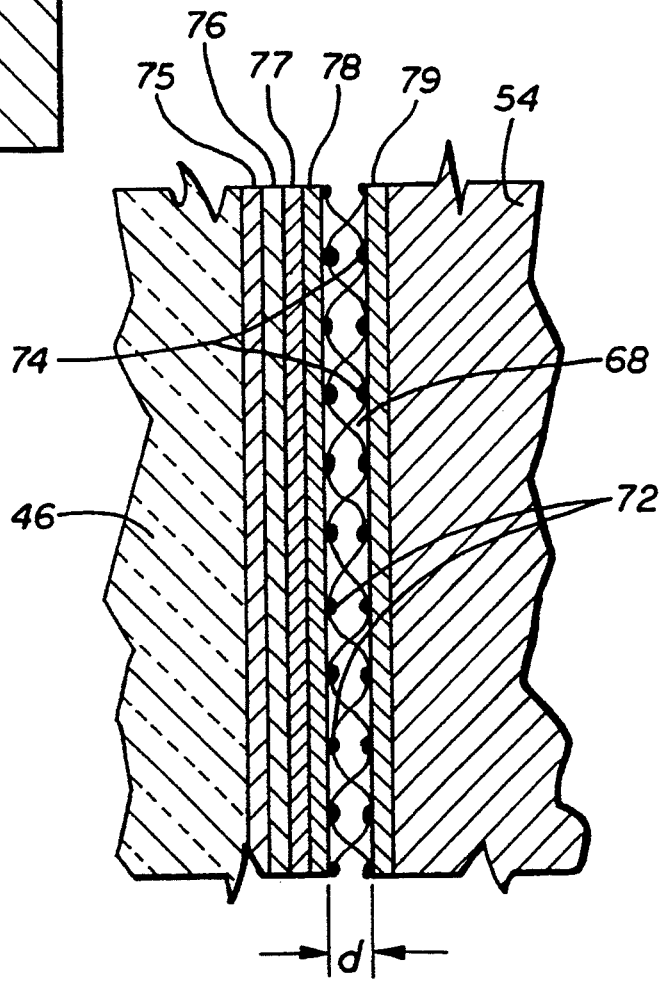
FIG. 3 is a greatly enlarged view of the interfacing regions of the sever pole piece and a termination piece and including a waffle plate in accordance with the invention taken within the dashed boundary 3 of FIG. 2.

FIG. 3 is a greatly enlarged view of the interface region between the ceramic termination piece 46 and the sever pole piece 54 as defined by the dashed outline "3" of FIG. 2. The waffle plate 68 enhances the formation of a bond between thermally mismatched materials when one of those elements is a ceramic or other material that neither wets (i.e., brazing alloy does not adhere or flow on it) nor adheres to braze alloys. An appropriate metallization can be employed on the hard-to-wet ceramic that forms a eutectic or lower melting point alloy with the wrinkle plate 68. The undesired leeching of metal atoms from the ceramic element 46 that can sometime occur in the prior art due to the direct brazing of certain materials to one another can in this case be prevented by careful selection of the material of the wafer and the materials used to attach the wafer to the ceramic. For example, a high power BeO—SiC or AlN—SiC termination piece 46 can be thermally and r.f. grounded by metallizing the termination piece 46 with a bonding layer 76 of titanium, a diffusion barrier layer 77 of molybdenum, overcoated with a final layer 78 of silver. The layer 78 may also comprise NiCuSil, CuSil, Ag or other brazing alloy. In the event that the wrinkle plate 68 is of copper, the copper and silver will alloy at their eutectic temperature on the termination side as indicated by the alloys 72. If AlN-SiC (aluminum nitride impregnated with silicon carbide) or other non-oxide bearing ceramic is used then an oxide adhesion layer 75 must be formed on the ceramic by, for example, air firing the aluminum nitride at an elevated temperature. The oxide layer provides adhesion between the ceramic and the Ti layer.

The other element in the "sandwich" may be almost any other material. In the event that a copper sever pole piece 54 is employed then a conventional silver, NiCuSil, other CuSil or alloying brazed material may be employed to form the braze alloy at the points of tangency 74. The copper sever pole piece 54 is preferably coated with a layer 79 of silver formed either by deposition thereof or by the use of silver shim stock.

The assembly described above is clamped and heated to a temperature just below the melting temperature of Cu and Ag. As a result, a eutectic is formed, bonding the Cu and Ag interfaces on either side of the wafer 68.

While the use of the wrinkle plate 68 provides separation, while maintaining thermal conductivity, between the ceramic termination piece and the copper sever pole piece, the separation distance "d" must not become excessive in r.f. applications. That is, d must be significantly less than the wavelength of the highest r.f. frequency employed since a large gap will affect the characteristic impedance of the assembly and cause a mismatch within the tube 10. As mentioned earlier, such impedance mismatches may result in undesired reflections and oscillations.

Figure 5:
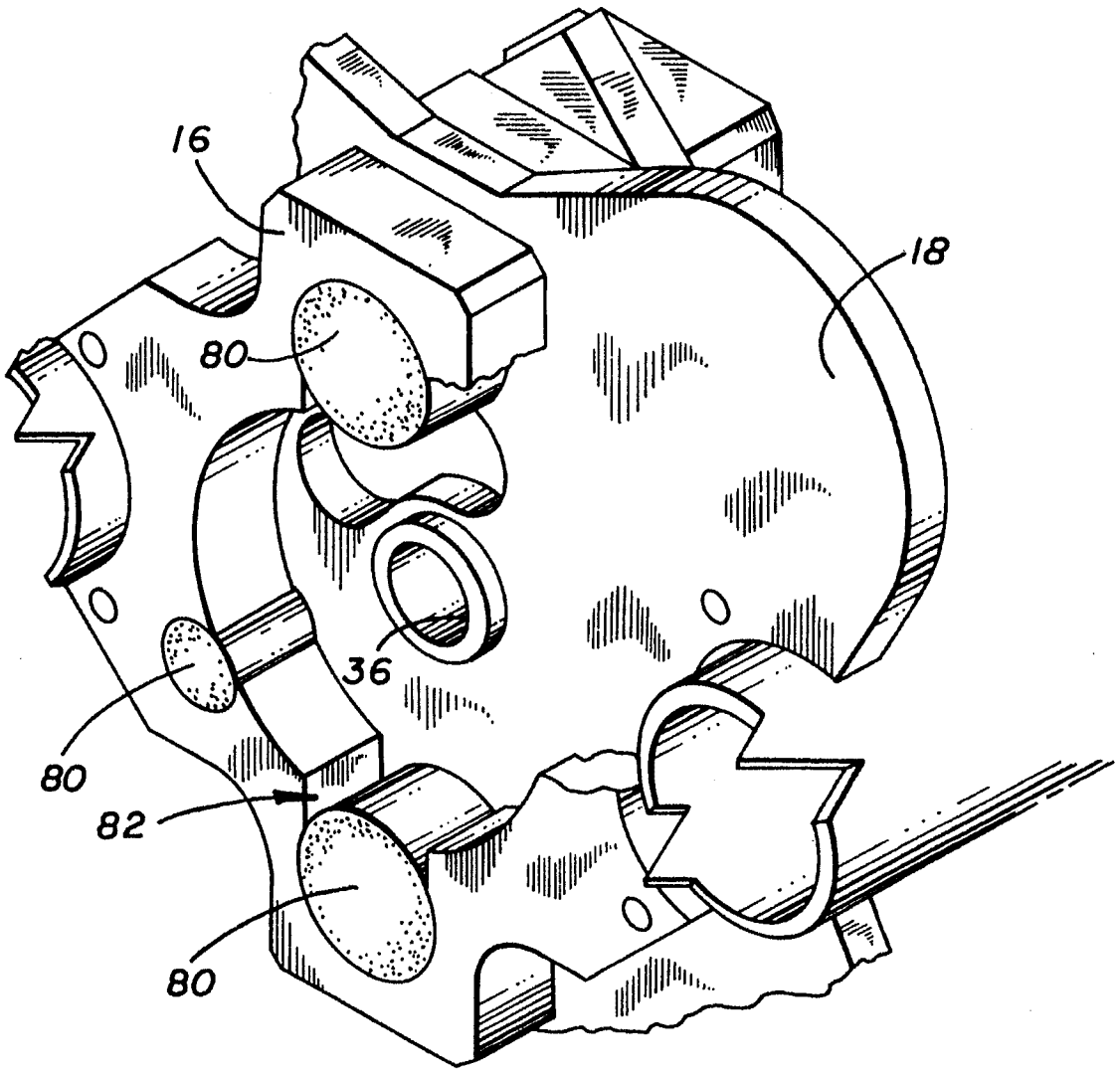
FIG. 5 is a partial perspective view of a portion of an interaction cavity of the traveling wave tube of FIG. 1 for illustrating the arrangement of loss buttons in accordance with the invention.

FIG. 5 is a partial perspective view of a portion of an interaction cavity of the traveling wave tube 10 of FIG. 1 for illustrating the arrangement of loss buttons 80 in accordance with the invention. As is shown, each of the loss buttons 80 is seated within a button cavity 82. The button cavities 82 are arranged about the inner periphery of a central aperture of a metallic spacer 16.

A traveling wave tube 10 may include various numbers and arrangements of loss buttons 80 and the choice thereof will depend upon the amount of power and the spectrum of wavelengths requiring attenuation. The resonant frequency of the button resonant cavity 80 itself is determined by its diameter while the air gap (defined as the distance between the surfaces of the pole pieces 18 and the opposed parallel surfaces of the button 80) also influences the resonant frequency of the button cavity 82.

In the invention, the opposed planar surfaces of the pill-shaped buttons 80 are coated with an appropriate metallization while the circumferences of the buttons 80 are uncoated to allow r.f. coupling between the spacer 16 and the button 80. Unlike the loss buttons of the prior art whose planar front and rear surfaces are uncoated, the tuned frequency of the button cavity 82 cannot be affected by the temperature-sensitive, and therefore difficult to control, size of the cavity air gap. The r.f. energy that enters a loss button 80, through its uncoated periphery from an associated spacer 16 encounters a chamber whose dimensions (and, thus, resonant frequency) is substantially unaffected by the growth, in most cases, of the rest of the tube 10 that occurs both during brazing and operation. Such shrinkage results from the extreme temperatures encountered by the metallic tube elements during brazing. The tuned frequency of the button cavity 82 remains stable despite dimensional changes to surrounding structures that affect the sizes of the button cavity air gaps.

Rather, in the present invention, the metallic coatings of the front and rear planar button surfaces result in the creation of a resonant cavity whose dimensions coincide with those of the button itself. While the loss buttons are subjected to the same extreme temperatures as the rest of the structures and elements comprising the tube 10, its primarily-ceramic composition renders it much less subject to dimensional change than those other structures.

The functional difference between a tube 10 incorporating loss buttons in accordance with the invention and one utilizing conventional uncoated buttons follows from the capacitive effects of the air gaps formed at either end of a loss button. In the prior art wherein the loss buttons are uncoated, the air gaps form a portion of the resonant circuit. Accordingly, the unavoidable changes to the air gaps that occur during brazing and operation result in corresponding changes to such capacitive values that affect the resonant frequency of the circuit. In contrast, by coating the faces of the loss buttons, the buttons themselves serve as the resonant circuits and the sizes of the air gaps do not enter into the value of the resonant frequency.

FIGS. 6(A) and 6(B) are top plan and elevation views, respectively, of a loss button 88 in accordance with the invention. The location of the button within the tube 10 determines the portion of the spectrum absorbed therein. A representative button 88 may have a thickness of between 0.15 and 0.20 inches.

The interior portion 90 of the button 88 is formed of an appropriate ceramic material such as aluminum oxide, magnesium oxide or beryllium oxide impregnated with silicon carbide while the planar front and rear faces 92 and 94 (see FIG. 6(B)) respectively are coated to depths of approximately 1.5 microns with an appropriate metal 97 such as tungsten that is characterized by good electrical conductivity and temperature related properties. The interior thermally inert ceramic portion of the button 88 comprises about 99 per cent of its material composition, significantly limiting the response of the button 88 to temperature change. Alternatively materials for the metal layers include chromium. Very thin layers 98 (a few Angstroms thick) of chromium which becomes oxidized at brazing temperatures, overlie the metal layers, protecting them from adhesion to other metallic elements of the tube 10 during brazing.

The metallic layers and coatings are preferably deposited by physical vapor deposition or sputtering. A central portion 96 (about 20 per cent) of one of the faces is ground after manufacture to adjust the resonant frequency of the button 88. The silicon carbide constitutes the lossy portion of the button 88 and the percentage of such material within the interior portion 90 determines the strength of attenuation afforded by the pill-like button 88, an increase in such percentage increases the resonant loss bandwidth.

Thus it is seen that the present invention provides improved loss buttons for use in a traveling wave tube of the coupled cavity type. By employing buttons in accordance with the invention, one can be assured of attaining and preserving the desired attenuation characteristics of a particular traveling wave tube design in the presence of the greatly-elevated temperatures encountered both during tube manufacture (brazing) and operation. The physical design of the improved loss buttons is not complex. Yet, by coating the front and rear planar faces of the buttons one can obtain significantly improved tube attenuation stability unhindered by the problems of prior art arrangements due to the capacitive effects of air gaps.

While the present invention has been described with reference to its presently preferred embodiment it is not limited thereto. Rather, this invention is limited only insofar as it is defined by the following set of patent claims and further includes within its scope all equivalents thereof.

What is claimed is:

1. A loss button for a traveling wave tube of the type that includes a slow wave structure comprising a plurality of axially-aligned interaction cavities operatively coupled to one another, each of said cavities including a pair of pole pieces for defining front and back walls thereof and at least one metallic spacer disposed between and providing separation between said front and back walls, said at least one spacer including at least one aperture for receiving a loss button therein, said loss button comprising, in combination:

a) a substantially pill-shaped body comprising lossy material;

b) said body having front and rear surfaces;

c) the front and rear surfaces of said body having respective metallizations thereon; and d) said metallizations being further coated with preselected material for preventing adhesion of said metallizations to braze alloys.

2. A loss button as defined in claim 1 wherein said lossy material comprises preselected ceramic material.

3. A loss button as defined in claim 2 wherein said ceramic material comprises about 99 per cent of said material.

4. A loss button as defined in claim 2 wherein each of said metallizations is about 1.5 to 2.0 microns in thickness.

5. A loss button as defined in claim 2 wherein said metallizations are comprised of tungsten.

6. A loss button as defined in claim 2 wherein said metallizations comprise chromium.

7. A loss button as defined in claim 1 wherein said preselected material is insulative.

8. A loss button as defined in claim 7 wherein said insulative material comprises chromium oxide.

9. A loss button as defined in claim 1 wherein said preselected material is comprised of chromium.

* * * * *